United States Patent [19]

Purnell

[11] Patent Number: 4,731,129

[45] Date of Patent: Mar. 15, 1988

[54] SUPERPLASTIC ZINC/ALUMINUM ALLOY

[75] Inventor: Charles G. Purnell, Wantage, England

[73] Assignee: BNF Metals Technology Centre, Oxon, England

[21] Appl. No.: 899,142

[22] Filed: Aug. 22, 1986

[30] Foreign Application Priority Data

Aug. 22, 1985 [GB] United Kingdom ..... 8521017

[51] Int. Cl.[4] ..... C22C 18/04; C22F 1/16

[52] U.S. Cl. ..... 148/11.5 R; 148/441; 420/516; 420/902

[58] Field of Search ..... 420/516, 902; 148/11.5 R, 158, 405, 441

[56] References Cited

FOREIGN PATENT DOCUMENTS 1225819 3/1971 United Kingdom ..... 420/902

*Primary Examiner*—L. Dewayne Rutledge
*Assistant Examiner*—Robert L. McDowell
*Attorney, Agent, or Firm*—Wenderoth, Lind & Ponack

[57] ABSTRACT

A zinc/aluminum alloy feedstock containing 18-30% by weight Al, 0.003-0.2% by wt. Mg, 0.5-2.5% by wt. Cu, 0.02-0.5% by wt. Fe, 0-0.1% by wt. Si, Zn balance (including any impurities) is capable of achieving high plasticity at temperatures of 240° C. or above after being subjected to a multistage heat treatment including an extrusion step.

7 Claims, No Drawings

SUPERPLASTIC ZINC/ALUMINUM ALLOY

The present invention relates to superplastic alloys based on zinc and aluminum and to methods of producing them. More particularly, it relates to zinc aluminum alloys of eutectoid or near-eutectoid composition which, upon suitable heat treatment, exhibit the property of superplasticity.

The binary zinc aluminum eutectoid alloy containing 22% by weight aluminum (Zn22Al) was among the first alloys to be rendered superplastic. This superplastic alloy is described by W. A. Backofen, I. R. Turner and D. H. Avery in "Transactions of The ASM" 1964, Volume 57 pages 980 to 990. The conventional treatment to render Zn22Al superplastic is to quench the alloy from a temperature above to a temperature below eutectoid temperature, typically from about 350° C. to room temperature. This treatment brings about a transformation in the structure of the alloy from a monophase which exists above the eutectoid temperature to a fine two-phase equiaxed grain structure. The presence of this equiaxed structure results in the alloy exhibiting superplasticity at temperatures approaching the eutectoid temperature (275° C.). Unfortunately, this binary eutectoid has poor conventional mechanical properties, e.g. poor tensile and creep strengths, at room temperature. The addition to Zn22Al alloys of small amounts of magnesium and copper was shown to improve the creep resistance, strength and corrosion resistance of the alloy without seriously impairing its superplastic properties. A. E. W. Smith and G. A. Hare reported in "Journal of The Institute of Metals", 1973, Volume 101, pages 320–328, that small additions of magnesium and, to a lesser extent, copper to Zn22Al retard the transformation to the two-phase equiaxed structure necessary for the material to exhibit superplasticity. Fu-wen Ling and D. E. Laughlin "Metallurgical Transactions A", 1979, Volume 10A, pages 921 to 928 report that, for such alloys, superplasticity can be achieved, after quenching, only by a combination of heat treatment and mechanical working of the alloys. According to their results, the transformation to a two-phase structure would be essentially completed after about 10 minutes at temperatures of from 150° to 250° C.

Conventionally, quaternary alloys based on the zinc-/aluminum eutectoid containing additions of magnesium and copper and quinary alloys which also contain small amounts of calcium, are rendered superplastic by quenching from a temperature of about 360° C. to room temperature, permitting transformation to the two-phase structure to occur and then extruding or rolling at elevated temperatures, typically at about 250° C. The superplastic behaviour of such alloys based on Zn22Al eutectoid is a sensitive function of grain size. Commercially rolled sheet of such alloys achieves a minimum grain size of about 2 μm. At this grain size, optimum plasticity is achieved at a strain rate of $\approx 2\times10^{-4}$ $sec^{-1}$. According to H. Naziri and R. Pearce, "Journal of the Institute of Metals", 1973, Volume 101, pages 197 to 202, a reduction of grain size to 0.5 μm in a near-eutectoid binary alloy containing 80 wt% zinc and 20 wt% aluminum (as a rolled sheet) results in the optimum plasticity occurring at a much higher strain rate of about $10^{-1}$ $sec^{-1}$. From an industrial view point it is clearly desirable that fabrication from the alloy should take place as rapidly as possible, compatible with good ductility. Generally speaking, strain rates utilized in industrial processes are typically in the range of from 1 to $10^4$ $sec^{-1}$. Therefore, superplastic alloys based on the zinc/aluminum eutectoid have not been considered suitable for deformation by industrial processes since these alloys tend to achieve optimum plasticity at strain rates lower than this range.

The present invention is based on the discovery that we can produce extrusions in an alloy based on the zinc/aluminum etectoid with a eutectoid grain size of 1 μm or less, the extruded eutectoid material being extremely ductile at strain rates typically used in industrial processes.

The present invention provides a method of making a superplastic alloy which method comprises:

(1) heating an alloy having the following composition

| | (content, % by weight) |
|---|---|
| Al | 18–30 |
| Mg | 0.003–0.2 |
| Cu | 0.5–2.5 |
| Fe | 0.02–0.5 |
| Si | 0–0.1 |
| Zn | balance |

at a temperature greater than 275° C. but below solidus until homogeneity of the high temperature zinc-/aluminum matrix is substantially obtained;

(2) quenching the alloy;

(3) extruding the alloy at a temperature of from 150° to 225° C.; and (4) as a separate stage, either before or after the extrusion step (3), annealing the alloy at a temperature of from 200° to 250° C. for at least one hour.

Surprisingly, it was discovered that prior to the annealing stage, the alloy matrix had not undergone complete transformation to a two-phase structure as previous work would suggest but remained substantially as a metastable monophase. The annealing process however substantially completes transformation to a fine grained, two-phase equiaxed structure.

The feedstock utilised in the present invention, which is an alloy based on the zinc/aluminum eutectoid or near eutectoid composition containing minor additions of magnesium, copper, and iron and optionally containing silicon, will have a composition as follows:

| | |
|---|---|
| Al | 18–30% by weight |
| Mg | 0.003–0.2% by weight |
| Cu | 0.5–2.5% by weight |
| Fe | 0.02–0.5% by weight |
| Si | 0–0.1% by weight |
| Zn | balance |

In addition, lead, cadmium and tin may be present as impurities.

Preferably, the feedstock will have a composition as follows:

| | |
|---|---|
| Al | 20–28% by weight |
| Mg | 0.003–0.2% by weight |
| Cu | 0.5–2.5% by weight |
| Fe | 0.02–0.15% by weight |
| Si | 0–0.05% by weight |
| Zn | balance |

Initially, in the method of the invention, the feedstock is heated above 275° C. (the eutectoid temperature) but below solidus in order to produce a substantially homogeneous matrix. Typically, this homogenisation is effected by heating the alloy, usually as cast billets, at a temperature of about 340° C. to 380° C. for a few hours. The heated alloy is then quenched, usually to room temperature. In accordance with the findings in earlier studies on zinc-aluminum eutectoid alloys, it was expected that transformation would follow quenching, in line with the temperature/time/transformation curves of Smith and Hare, supra and those of Ling and Laughlin, supra. However, as mentioned above, transformation did not occur and an examination of the alloy after quenching revealed that the alloy matrix was monophase.

According to one embodiment of the invention, the quenched alloy is heated to a temperature of from 150° to 200° C. and then extruded. Following extrusion, the extruded alloy may be air-cooled on the runout table. The extruded product is then annealed at a temperature of from 200° to 250° C. for at least one hour to transform the alloy to the two-phase structure. Typically, the annealing is carried out at a temperature of about 220° C. for 2 hours.

According to another embodiment of the invention, the billet, after quenching, is annealed to transform the alloy prior to the extrusion stage. As in the case mentioned above, the annealing is typically carried out at about 220° C. for about 2 hours. The alloy may be air cooled. Following this, the transformed alloy is extruded typically at a temperature of 175° to 225° C.

In an especially preferred embodiment, the present invention provides a method of making a superplastic alloy which method comprises:

(1) heating an alloy based on the zinc/aluminum eutectoid with minor additions of magnesium and copper and containing 0.14% by weight of iron and 0.025% by weight of silicon at about 350° C. for about 20 hours;

(2) quenching the alloy into water at room temperature;

(3) preheating the alloy to a temperature of from 150° to 200° C.;

(4) extruding the alloy at the same temperature as used in the heat-treatment (3); and (5) annealing the extruded alloy at about 220° C. for about 2 hours.

By this method, we have produced extrusions which combine good surface quality with a grain size of less than 1 μm, after annealing.

According to another preferred embodiment, an alloy having the following composition

| | content, % by weight |
|---|---|
| Al | 25–28 |
| Mg | 0.003–0.2 |
| Cu | 0.5–2.5 |
| Fe | 0.02–0.15 |
| Si | 0–0.05 |
| Pb, as impurity, not greater than 0.005 | |
| Cd, as impurity, not greater than 0.004 | |
| Sn, as impurity, not greater than 0.003 | |
| Zn | balance |
| is heated at about 350° C. for about 20 hours; | |

(2) the alloy is then quenched into water at room temperature;

(3) the thus-quenched alloy is annealed at about 220° C. for about 2 hours; and (4) the annealed alloy is extruded at a temperature of from 150° to 200° C.

Surprisingly, we have found that the alloy obtained by the present invention is extremely plastic at temperatures of 240° C. or greater at strain rates greater than 1 $sec^{-1}$ and even as high as 150–250 $sec^{-1}$. Such a property would not be expected from the results of previous studies on superplastic zinc/aluminum alloys.

The combination of desirable properties shown by alloys prepared by the method of the invention, e.g. low cost, low deformation temperatures, high ductility during deformation at strain rates typical of industrial processes, indicate that these alloys may be very useful as stamping or forging feedstocks.

EXAMPLE 1

Offcuts of rolled sheet having an alloy composition as follows:

| | | |
|---|---|---|
| Zn:Al | 78:22 | by weight |
| Cu | 0.99 | wt % |
| Mg | 0.005 | wt % |
| Fe | 0.14 | wt % |
| Si | 0.025 | wt % |

were melted to produce cylindrical chill castings large enough for turning to 100 mm diameter. Microsections of the feedstock rolled sheet showed that these had a grain size of ≈2 μm, and also incorporated gross stringers of inclusions of an intermetallic. Microprobe analysis indicated that the stringers had high concentration of iron, silicon, zinc and aluminum. Such intermetallics are found in aluminum alloys cast with a relatively impure (99.5%) basis aluminum. The stringers were of hardness ≈500 HV.

The length of each casting was sufficient to generate four extrusion billets of length ≈250 mm from each cast.

The turned billets were homogenised at 350° C. for twenty hours and quenched into water at room temperature.

The alloy at this stage was found to be in the form of the metastable monophase.

Extrusion trials by direct extrusion were carried out on the alloy at extrusion temperatures of 150° and 175° C. Billet tooling and container were held at these temperatures prior to extrusion. The product was 18 mm diameter rod extruded through a die of TZM (molybdenum titanium zirconium alloy) bell-mouthed with an entry radius of 1.5 mm at an extrusion ratio of 31. Breakout loads of 750 tonnes and 659 tonnes were recorded for two billets extruded at 150° C., and 597 tonnes at 175° C. In the case of the two billets extruded at 175° C. minimum loads of 406 and 308 tonnes were recorded during extrusion. Surface quality of the extrusions was excellent, at a runout velocity of 26 4 km/hr.

Examination of the extruded product showed that the grain size of the metastable phase was ≈1 μm, the volume proportion of the hard (FeZnSiAl) intermetallics was ≈0.5 vol % and the form of the intermetallics was as fine cuboids of dimension 10–15 μm. Microhardness values for the matrix 55 days after extrusion were about 70 HV. Tensile tests conducted on the extruded rod 127 days after extrusion gave an Ultimate Tensile Strength (UTS) of ≈600 $N/mm^2$ and elongation of <1%. The extruded rods were then annealed at a temperature of 220° C. for 2 hours to transform the monophase to a two-phase structure. After the transformation, the grain size of the two phase structure was less than 1 μm. The alloy then had a UTS of ≈300 N/mm² and elongation of 15% at room temperature.

EXAMPLE 2

Two billets were prepared from the Feedstock as described in Example 1 and these billets were homogenised at 350° C. for twenty hours and quenched into water at room temperature. After homogenisation, and quenching, the alloy in the billets was in the metastable monophase condition.

The billets were transformed by a furnace anneal at 220° C. for two hours followed by furnace cooling.

These were extruded to 18 mm rod using the TzM bell-mouthed die in Example 1, with one billet preheated to 200° C. and the other to 225° C. The extrusion tooling and container were held at the billet temperature prior to extrusion. The billets were put into a furnace at temperature one hour prior to extrusion.

The breakout load registered at the press was 365 tonnes for the 200° C. billet and 360 tonnes for the 225° C. billet. The minimum loads during extrusion were 298 tonnes for each billet.

The surface quality of the extrusions was not as good as for the metastable billets, in particular both extrusions showed surface tearing towards the back end. In both extrusions, coarsening of the grain size was evident towards the back end, at a runout velocity of 4 km/hr.

Sections taken from the extrustions again showed a fine grain size (≈1 μm). The grain size in the product from the 225° C. billet was slightly more coarse.

EXPERIMENTAL

Upsetting tests on extruded rod

The simple upsetting test in which a standard weight is dropped from a known height onto a cylindrical specimen of test material was used to assess the formability of the extruded materials of Examples 1 and 2.

The equipment used in these tests involved the dropping of a tup of mass 54.5 kg onto a specimen supported on a platen. The adjustable variables in these experiments were the drop height, and the specimen geometry.

In stamping the rods it was possible to use PTFE film as a lubricant to prevent barrelling. Some tests conducted in this way were used to assess the variation in degree of deformation with temperature. For the remainder of the tests, in which tests on stamping brass to BS.218 were included for comparison of flow stresses, no PTFE was used, and the tooling was not preheated above ambient temperature.

One series of tests was conducted to compare the degree of deformation of samples upset at temperatures varying from 250° C. to 300° C., and also to compare samples extruded before and also after transformation to the two phase condition. The results of these tests show that the flow stresses of the materials transformed before and after extrusion were similar at a given temperature, and that the degree of deformation increased with increasing temperature.

Comparative tests on brass to BS.218 stamped at 700°-800° C. showed that the flow stress for the brass at its optimum stamping temperature (700°-750° C.) was about half that of the samples obtained in Examples 1 and 2 for comparable strain rates of ≈150 $sec^{-1}$, but the brass showed surface cracking in all the tests carried out. By using smaller specimens or by increasing the kinetic energy of the tup it was possible to deform the samples obtained in Examples 1 and 2 to strains as great as those undergone by the brass. The samples obtained in Examples 1 and 2 were stamped to >80% height reduction without cracking; BS218 brass showed surface cracking even at 66% reduction under these conditions.

A microsection taken of a sample of the material obtained in Example 2 stamped to 76% reduction at 275° C. showed evidence of local transformation to the high temperature phase from which the flow pattern in the stamping could be discerned, but there was no surface cracking and no evidence of local shear banding.

EXAMPLE 3

Examples 1 and 2 describe the method of the present invention applied to an alloy based on a zinc-22% aluminum alloy with minor alloying elements. This example describes its application to an alloy based on zinc-27% aluminum with minor alloying elements.

A commercially available sand casting alloy was used for the raw material. This alloy, commonly known as ZA27, is described in the British Standards Institutions's Draft for Development document DD139 which gives the following compositionsl limits for ingot and castings in this alloy:

| | Ingot | Castings |
|---|---|---|
| Al | 25.5-28.0 | 25.0-28.0 |
| Mg | 0.015-0.020 | 0.010-0.020 |
| Cu | 2.0-2.5 | 2.0-2.5 |
| Fe | 0.07 max | 0.10 max |
| Pb | 0.004 max | 0.005 max |
| Cd | 0.003 max | 0.004 max |
| Sn | 0.002 max | 0.003 max |

Ingots to the above specification were melted and cast into extrusion billets as in Example 1.

The iron content of the cast billets was analysed and was found to be between 0.06 and 0.07%.

The billets were homogenized at 350° C. for 20 hours and then quenched in cold water. Slices cut from the billets were tested for room temperature ageing by taking Vickers Hardness measurements at various times after quenching. Immediately after quenching variable hardness of between 106 to 145 HV was obtained. After standing for 48 hours at room temperature all the material had hardened to 170-180 HV.

Billets were then heat treated for 3 hours at 180° C. and air cooled. The Vickers Hardness for that material after cooling was measured as between 170-180 HV. This heat treatment had not significantly softened the material. Billets were then heat treated at 220° C. for 2 hours after which the Vickers Hardness was measured as 117 HV. This material was then extruded to 18 mm diameter rod at a temperature of 180° C.

Alloy ZA27 is included in ASTM Specification B669-84 for zinc alloys in ingot form for foundry castings, which quotes the following composition requirements:

| | wt % |
|---|---|
| Al | 25.0-28.0 |
| Mg | 0.010-0.020 |
| Cu | 2.0-2.5 |

-continued

| | wt % |
|---|---|
| Fe | 0.10 max. |
| Pb | 0.004 max |
| Cd | 0.003 max |
| Sn | 0.002 max. |
| Zn | rem. |

Samples of the extruded rod from Example 3 were subjected to the upsetting test described above, and could be stamped to an 80% height reduction with tooling at room temperature and at high strain rates (>150 $sec^{-1}$), after which occasional small cracks could be seen only at the free peripheral surface. Microsections showed that these cracks were of depth not greater than 0.03 mm, and were of a blunt semi-circular cross-section. No evidence of local shear banding could be seen in the hot-stamped pieces.

I claim:

1. A method of making an alloy capable of being superplastically deformed which method comprises (1) heating an alloy having the following composition

| | content, % by weight |
|---|---|
| Al | 18–30 |
| Mg | 0.003–0.2 |
| Cu | 0.5–2.5 |
| Fe | 0.02–0.5 |
| Si | 0–0.1 |
| Zn | balance |

at a temperature greater than 275° C. but below solidus until homogeneity of the high temperature zinc/aluminum matrix is substantially obtained;

(2) quenching the alloy;

(3) extruding the alloy at a temperature of from 150° to 225° C.; and (4) as a separate stage, either before or after the extrusion step (3), annealing the alloy at a temperature of from 200° to 250° C. for at least one hour.

2. The method of claim 1, wherein the alloy heated in step (1) has a composition as follows:

| | content, % by weight |
|---|---|
| Al | 20–28 |
| Mg | 0.003–0.2 |
| Cu | 0.5–2.5 |
| Fe | 0.02–0.15 |
| Si | 0–0.05 |
| Zn | balance |

3. The method of claim 1, wherein the alloy in step (1) is heated at a temperature of from 340° C. to 380° C. until the zinc/aluminum matrix is substantially homogeneous.

4. A method of making a superplastic alloy which method comprises (1) heating an alloy based on the zinc/aluminum eutectoid with additions of magnesium and copper and containing 0.14% by weight of iron and 0.025% by weight of silicon at about 350° C. for about 20 hours;

(2) quenching the alloy into water at room temperature;

(3) preheating the alloy to a temperature of from 150° to 200° C.;

(4) extruding the alloy at the same temperature as used in step (3); and (5) annealing the extruded alloy at about 220° C. for about 2 hours.

5. A method of making a superplastic alloy which method comprises (1) heating an alloy having the following composition

| | content, % by weight |
|---|---|
| Al | 25–28 |
| Mg | 0.003–0.2 |
| Cu | 0.5–2.5 |
| Fe | 0.02–0.15 |
| Si | 0–0.15 |
| Pb | up to 0.005, as impurity |
| Cd | up to 0.004, as impurity |
| Sn | up to 0.003, as impurity |
| Zn | balance |

at about 350° C. for about 20 hours;

(2) quenching the alloy into water at room temperature;

(3) annealing the alloy at about 220° C. for about 2 hours; and (4) extruding the alloy at a temperature in the range of from 150° to 200° C.

6. A two-phase alloy consisting of

| | content, % by weight |
|---|---|
| Al | 18–30 |
| Mg | 0.003–0.2 |
| Cu | 0.5–2.5 |
| Fe | 0.02–0.5 |
| Si | 0–0.1 |
| Zn | balance (including impurities) |

which alloy is superplastic at a temperature of 240° C. or above at a strain rate greater than 1 $sec^{-1}$.

7. The two-phase alloy of claim 6, consisting of:

| | content, % by weight |
|---|---|
| Al | 25–28 |
| Mg | 0.003–0.2 |
| Cu | 0.5–2.5 |
| Fe | 0.02–0.15 |
| Si | 0–0.05 |
| Pb | up to 0.005, as impurity |
| Cd | up to 0.004, as impurity |
| Sn | up to 0.003, as impurity |
| Zn | balance. |

* * * * *